US005875526A

United States Patent [19]

Yamaguchi

[11] Patent Number: 5,875,526

[45] Date of Patent: Mar. 2, 1999

[54] FEMALE MEMBER OF A HOOK-AND-LOOP FASTENER

[75] Inventor: Tosirou Yamaguchi, Osaka, Japan

[73] Assignee: Kuraray Co., Ltd., Kurashiki, Japan

[21] Appl. No.: 809,148

[22] PCT Filed: Jul. 19, 1996

[86] PCT No.: PCT/JP96/02012

§ 371 Date: Mar. 26, 1997

§ 102(e) Date: Mar. 26, 1997

[87] PCT Pub. No.: WO97/04679

PCT Pub. Date: Feb. 13, 1997

[30] Foreign Application Priority Data

Jul. 26, 1995 [JP] Japan ..... 7-190331

[51] Int. Cl.[6] ..... A44B 18/00

[52] U.S. Cl. ..... 24/445

[58] Field of Search ..... 24/442, 445; 442/308, 442/309, 312; 66/202, 196, 198

[56] References Cited

U.S. PATENT DOCUMENTS

| | | | |
|---|---|---|---|
| 4,624,116 | 11/1986 | Rogers | 24/445 X |
| 4,709,562 | 12/1987 | Matsuda | 24/445 X |
| 5,214,942 | 6/1993 | Peake, III et al. | 24/445 X |
| 5,267,453 | 12/1993 | Peake, III et al. | 24/445 X |

*Primary Examiner*—James R. Brittain
*Attorney, Agent, or Firm*—Oblon, Spivak, McClelland, Maier & Neustadt, P.C.

[57] ABSTRACT

A female member of a Hook-and-Loop fastener made of double knit goods, in which a pile is provided at least in a portion on one side A of the double knit goods. The pile contains a crimped yarn, the percentage crimp ($K_1$) of which is not more than 15%, the single fiber fineness of filaments composing the yarn is not less than 3 denier; and the yarn is knitted together with the yarn composing the other side B of the double knit goods only on one side A.

3 Claims, 5 Drawing Sheets

FEMALE MEMBER OF A HOOK-AND-LOOP FASTENER

BACKGROUND OF THE INVENTION

1. Field of the Invention

The present invention relates to a female member of a Hook-and-Loop fastener made of double knit goods suitable for an outer side material of a seat designed to meet the requirement of superior decoration, and both fastening function and cushion function are integrally provided in this female member of the Hook-and-Loop fastener. More particularly, the present invention relates to a female member of a Hook-and-Loop fastener made of double knit goods suitable for recycling resources by making the female member of the Hook-and-Loop fastener made of a single material.

2. Background Art

It is well known that a cloth of a seat used for a vehicle or an aircraft, a cloth to cover a chair used in an office, or a pillow cover used for a chair in a vehicle is fastened to a male fastener fixed to a ground material. Conventionally, the fastening function is provided when nonwoven fabric or tricot fabric with loop, which functions as a female Hook-and-Loop fastener, is laminated or sewn onto the reverse side of a main body of the outer side material. Concerning the efficiency in the case of attaching the outer side material onto the main material of a seat used for a vehicle or an aircraft or a chair used in an office, the aforementioned conventional outer side material is satisfactorily used. Moreover, the aforementioned conventional outer side material appropriately fits to the seat, the surface of which is curved, and also the seat to which the aforementioned conventional outer side material has been attached can be comfortably used. However, in the above case, it is necessary for the outer side material to be integrated with a material having the fastening function by means of laminating and the like. Therefore, the cost of the outer side material is increased. In order to give a cushion property to the outer side material, or in order to maintain the stability of the shape of the outer side material, in some cases, foamed urethane rubber is laminated on the reverse side of the outer side material before nonwoven fabric or the like is laminated. In the above case, the manufacturing process becomes complicated and the cost is raised.

The conventional outer side material having the laminating structure described above is composed of different types of materials. It is necessary to separate and divide those materials during disassembly. Therefore, it is not easy to recycle the resources. As a result, after the outer side material has been used, it is subjected to a shredder and disposed for reclamation at present.

It is an object to solve the above problems of the conventional outer side material. That is, an object of the present invention is to provide a female member of a Hook-and-Loop fastener including: an outer side material which is not necessarily subjected to complicated processing such as laminating; and double knit goods, the surface of which is appropriately designed, and the reverse side of which is formed into a surface having a high fastening function by which the surface is tightly fastened to hook-shaped fastening elements. Another object of the present invention is to provide a female member of a Hook-and-Loop fastener including: an outer side material that is seldom displaced even if it is repeatedly attached to and detached from the hook-shaped fastening elements or even if it is used over a long period of time; and double knit goods by which the design of the surface of the outer side material is not affected.

In order to accomplish the above objects, the inventors have found the following facts.

(1) It is important to structurally form the yarn having pile or loops on one side.

(2) It is important for the stitches of the yarn of pile or the yarn having loops to be formed only on one side.

SUMMARY OF THE INVENTION

The first invention is described as follows. The present invention is to provide a female member of a Hook-and-Loop fastener made of double knit goods, characterized in that: pile is provided at least in a portion on one side A of the double knit goods; the pile contains the following yarn (1) or (2); the single fiber fineness of filaments composing the yarn is not less than 3 denier; and the yarn is knitted together with the yarn composing the other side B of the double knit goods only on one side A.

(1) Crimped yarn, the percentage crimp ($K_1$) of which is not more than 15%

(2) Blended yarn composed of crimped filaments and uncrimped filaments

Further, the second invention is described as follows. The present invention is to provide a female member of a Hook-and-Loop fastener made of double knit goods, characterized in that: the yarn (3) having ring-shaped loops, the height of which is 1 to 3 mm, is provided on one side A of the double knit goods; the single fiber fineness of filaments composing the yarn is not less than 3 denier; and the yarn is knitted together with the yarn composing the other side B of the double knit goods only on one side A.

DETAILED DESCRIPTION OF THE PREFERRED EMBODIMENT

Figure 1:
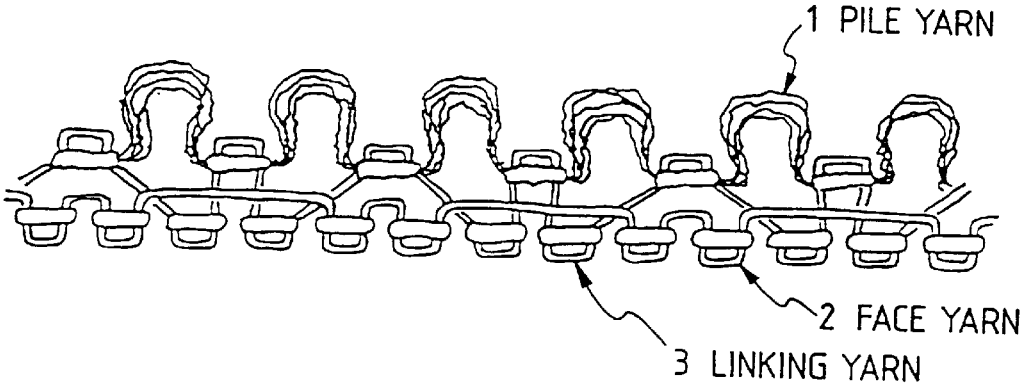
FIG. 1 is a cross-sectional view of the double knit goods composing the female member of the Hook-and-Loop fastener of the present invention.

In the first invention, it is important that the pile exists on an overall surface or in a portion on the surface of one side A of the female member of the Hook-and-Loop fastener. FIG. 1 is a view showing an example of the double knit goods having the pile of the first invention. In FIG. 1, reference numeral 1 designates a piece of pile yarn. These pieces of pile yarn are structurally integrated into one unit, and they function as a cushion layer and as a fastening to the hook-shaped fastening elements. Reference numeral 2 designates a piece of face yarn. For example, the pieces of face yarn form a side B of a seat cloth which comes into contact with the human body. Reference numeral 3 designates a piece of linking yarn. The pieces of linking yarn compose the side B and link the side A. The pieces of linking yarn 3 have a function to fix the pieces of pile yarn 1.

In this embodiment, the side A of the double knit goods on which pile is formed is either a front surface or a reverse surface of the double knit goods. However, it is preferable that the pile is knitted by a body yarn of double knit goods on the back side.

The double knit goods of the present invention are preferably used as a seat cloth. One side B opposite to the side A having the fastening function may be plain, however, a pattern such as a knitted-in pattern or a printed pattern on the surface of the solid fabric is preferably applied to the side B. Accordingly, when the pattern is made by a pattern device of a circular knitting machine, a side knitted on the cylinder side of the knitting machine is determined to be the side B that is appropriately designed, and a side knitted on the dial side of the knitting machine is determined to be the side A, on which the pieces of pile yarn having the fastening function and the piece of yarn having ring-shaped loops may be preferably arranged.

In this case, it is important that the stitches of pile yarn or the stitches of yarn having ring-shaped loops are connected the stitches of yarn composing the side B (the surface to be appropriately designed) only on the side A, that is, it is important that no stitch connections of the former yarn and the latter yarn are formed on the side B. The reason is described as follows. When the pieces of pile yarn or the pieces of yarn having ring-shaped loops are knitted in the form of stitches on the side B, the stitch loops are moved by various physical forces caused when they are attached to or detached from the hook-shaped fastening elements or when they are used as a seat cloth. As a result, the outer appearance of the side B, which is the side to be appropriately designed, is affected.

It is necessary that the female member of the Hook-and-Loop fastener of the present invention is provided with an interior decoration factor. Therefore, it is not allowed that the outer appearance of the female member is changed when it is used or fastened to a male member of a Hook-and-Loop fastener during assembly.

The pile may be formed at least in a portion on one side of the double knit goods. However, when the consideration is given to a fastening force caused when the pieces of pile yarn are fastened to the hook-shaped fastening elements of the male member of the Hook-and-Loop fastener, it is preferable that the number of pieces of pile of yarn per 1 $cm^2$ on one side is not less than 30.

In the double knit goods of the present invention, the side A and the side B are integrated into one unit by the linking yarn. Since the cushion property can be enhanced by adjusting the height of a cylinder verge to be higher than that of a normal operation, that is, by adjusting the height of the cylinder verge to be 3 to 7 mm, even if the pieces of pile of yarn are fastened to hard and rough fastening elements, the outer appearance of the double knit goods is not affected, so that the feeling of the double knit goods is remarkably excellent when they are used as a seat cloth.

In order to fasten the female member of the Hook-and-Loop fastener to the hook-shaped fastening elements of knit goods, it is not sufficient for knit goods that the female member is provided with the pile of yarn or hairiness-like ring-shaped loops on one side. In order to accomplish the fastening of the female member of the Hook-and-Loop fastener to the male member, the design of shapes of filaments to form the pile of yarn and the loops is very important.

It is important that the yarn to compose the pile capable of being fastened to the hook-shaped fastening elements must be one of the following items (1) to (3).

(1) Crimped yarn, the percentage crimp ($K_1$) of which is not more than 15%

(2) Blended yarn composed of crimped filaments and uncrimped filaments (3) Yarn having ring-shaped loops, the height of which is 1 mm to 3 mm.

In the case of using the yarn of item (3), if the yarn described later exists on one side A, the pile is not necessarily raised.

Not less than two of the items (1) to (3) may be combined to make the double knit goods.

In the case of crimped yarn described in item (1), the percentage crimp ($K_1$) of which is not more than 15%, the percentage crimp which is lower than that of the normal false twist yarn is characteristic itself in the present invention. Hook-shaped fastening elements can easily enter between the crimped filaments with a lower percentage crimp, so that the fastening elements can be more tightly fastened to the crimped filaments.

When the crimped yarn of a higher percentage crimp is used as the yarn of pile, the crimped yarn is entangled and lumped in the process of dyeing or finishing of the knitted goods. Therefore, it becomes difficult for the fastening elements to enter between the crimped filaments. As a result, the fastening property is deteriorated or the fastening elements are not fastened to the crimped filaments at all. For this reason, it is preferable that the percentage crimp of the crimped yarn is previously lowered to a predetermined value by means of heat setting. In order to lower the percentage crimp, the temperature of heat setting of false twisting is set at a value lower than the temperature of normal heat setting by 20° to 100° C. Alternatively, the number of false twist is reduced.

When the yarn that has not been crimped is used, or the yarn, the percentage crimp of which is very low, is used to form the pile, the formed pile does not rise perpendicularly to the surface of the knit goods. Accordingly, the pile can not be fastened to the hook-shaped fastening elements in a good condition. Consequently, it is preferable that the percentage crimp is maintained at a value not less than 2%.

The yarn described in item (2) is the blended yarn composed of crimped filaments and uncrimped filaments. These different filaments are subjected to air jet tangling treatment in which they are not formed into ring-shaped loops but they are tangled with each other.

Figure 2:
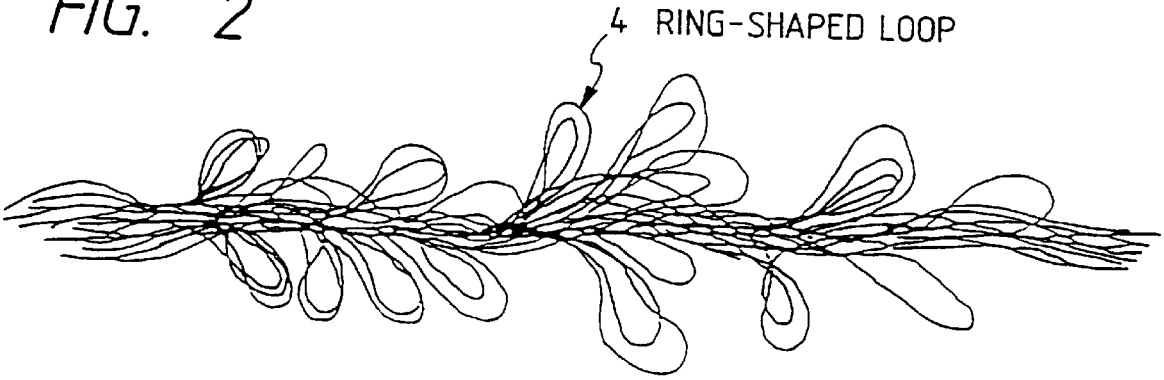
FIGS. 2 and 3 are side views of the yarn having ring-shaped loops 4 used for the female member of the Hook-and-Loop fastener of the present invention.
Figure 3:
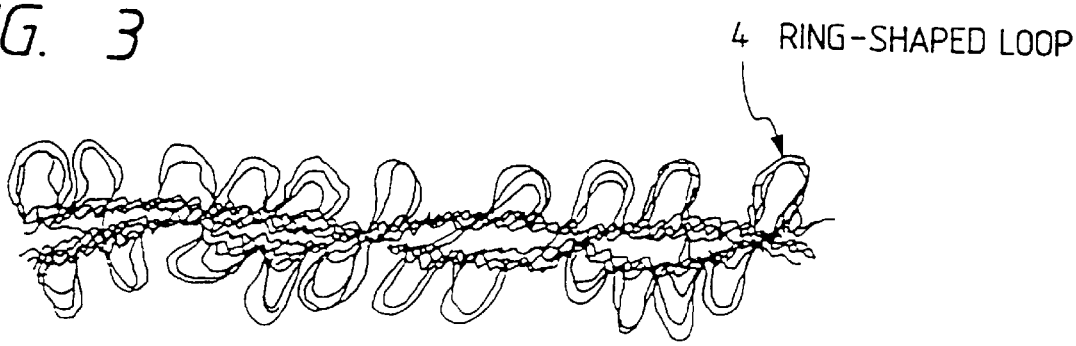

FIGS. 2 and 3 show a model in which pieces of yarn having ring-shaped loops described in item (3) are illustrated. FIG. 2 is a view showing pieces of yarn in which ring-shaped loops, the height of which is 1 mm to 3 mm, protrude from the side of the pieces of yarn, which is the air jet treated yarn (3-1) generally referred to as Taslan yarn. FIG. 3 shows the yarn (3-2) obtained in such a manner that not less than 2 pieces of yarn are folded after pieces of blended yarn with variants of shrinkage have been subjected to heat treatment under low tension.

The aforementioned air jet treated yarn (3-1) can be manufactured as follows. Multi-filaments for the sheath yarn and other multi-filaments are introduced to the air jet nozzle, and air is jetted into the nozzle. Then these multi-filaments are blended and tangled. When the over feed ratio is increased, the size and quantity of the ring-shaped loops are increased. Ends of these ring-shaped loops are restricted due to air-tangling. Accordingly, they are suitable when they are fastened to the male member of the Hook-and-Loop fastener.

It is important that the air-tangling satisfies the following expressions. When the over feed ratio of the sheath yarn is lower than 30%, the size and quantity of the ring-shaped loops are insufficient, and the number of loops that protrude from the fastening surface is reduced. Therefore, it is impossible to provide a sufficiently high intensity of fastening force. When the air pressure is lower than 3.0 $kg/cm^2$ of air jet texturing process, the pieces of yarn are not sufficiently tangled, and ends of the loops are released or ring-shape loops are not formed.

OF≧30

AP≧3.0 where OF is the over feed ratio (%) of the sheath yarn, and AP is the air pressure (kg/cm$^2$) of air jet texturing process.

Concerning the core yarn composing the air jet textment yarn (3-1), the strength-elongation and the mono-filament fineness are not particularly limited. However, when the mono-filament fineness is too high, it is difficult to form tangling parts of air jet texturing process, and even if the tangling parts are formed, they are easily damaged when they are attached to and detached from the hook-shaped fastening elements. Accordingly, in order to enhance the strength of tangling, it is preferable to use the core yarn made of filaments of the mono-filament fineness that is smaller than 3 denier, while the mono-filament fineness of filaments composing the sheath yarn is not less than 3 denier.

The over feed ratio of the core yarn is not particularly limited, however, it is preferable that a difference between the over feed ratio of the core yarn and the over feed ratio of the sheath yarn is made to be 50 to 100% because ring-shaped loops capable of being smoothly fastened to the hook-shaped fastening elements can be formed.

The yarn (3-2) having the ring-shaped loops shown in FIG. 3 is made as follows. Two or more types of multi-filaments, the difference of boiling shrinkage percentages of which is not less than 30%, are fed into an air jet nozzle, and then air is jetted into the nozzle so that these multi-filaments are blended. Then the yarn is subjected to heat treatment. At least two pieces of the thus heat treated yarn are folded. In this way, the yarn having the ring-shaped loops shown in FIG. 3 is obtained.

In the process of air-tangling, it is not necessary that the over feed ratio of the yarn of low boiling shrinkage percentage is set at a high value. It might be preferable that the over feed ratio is set at the same value. The reason is described as follows. In the following heat treatment, a continuous hank type heat setting machine of low tension under dry condition at 180° C. is employed, or alternatively a knit-de-knit method under wet condition at 130° C. is employed. Therefore, pieces of yarn in which loops are formed before the heat setting often obstruct processability. When the difference of boiling shrinkage percentages is not less than 30%, it is possible to obtain the target ring-shaped loops. An object of folding the heat-treated yarn is to make the yarn round and to make the ring-shaped loops rise perpendicularly to the knit goods even on the needle loops. Another object of folding the heat-treated yarn is to prevent the ring-shaped loops from being damaged when they are attached to and detached from the hook-shaped fastening elements.

The following are important. In the process of knitting, needle loops of the knit goods are given a tension higher than that of the sinker loops. Accordingly, when only a single piece of the heat-treated yarn is used, the formed ring-shaped loops are elongated in the process of knitting. Therefore, the ring-shaped loops disappear, and the loops can not be used for the purpose of fastening. The above problems occur when the size of the ring-shaped loops is excessively increased. Accordingly, when at least 2 pieces of heat-treated yarn are folded, a tension given in the process of knitting is dispersed, so that the shape of the ring-shaped loops can be maintained.

The size of the ring-shaped loops depends on the shrinkage percentage, air pressure and processing speed. It is preferable that the air pressure is set at 3 kg/cm$^2$ and above. Under the above conditions, it is possible to obtain the number of tangling that is not less than 100 pieces/m.

Pieces of yarn described in items (1) and (2) are usually used as pieces of pile yarn rising perpendicularly to the knit surface. However, pieces of yarn described in item (3) may be used as pieces of pile yarn rising perpendicularly to the knit surface, or alternatively they may be used in a condition of normal stitches.

However, in the case of the above (3-1) air-tangling yarn, when the number of the ring-shaped loops, the size of which exceeds 3 mm, is not less than 300 pieces/10 cm, the stability of yarn is deteriorated in the manufacturing process of the yarn, and also the failure of unwinding occurs in the process of knitting. In the case of the folded yarn of (3-2), the handling property is not good after the shrinkage treatment.

Concerning the fastening property, when the number of the ring-shaped loops, the size of which exceeds 3 mm, is not less than 300 pieces/10 cm, it is possible to obtain a sufficiently high fastening property as long as the loops are used as the pile yarn rising perpendicularly to the knit surface. However, in the case where the loops are used as normal stitches, the fastening property is deteriorated. The reason is described as follows. When the size of the ring-shaped loops exceeds 3 mm, the number of loops existing in the form of pile is remarkably lowered on the needle loop side of stitches. As result, the fastening property is deteriorated and the fastening force is lowered. When the number of the ring-shaped loops, the size of which is 1 to 3 mm, is not more than 100 pieces/10 cm, a large number of hairiness-like ring-shaped loops exist on the needle loop side of stitches. Accordingly, it is possible to provide a sufficiently high fastening property.

Next, in order to enhance the fastening property of the pile to the hook-shaped fastening elements, the single fiber fineness of the filaments composing the pieces of yarn must be 3 denier or more. In the case of single fiber fineness of the filaments which is smaller than 3 denier, a portion of the filaments are cut away when the filaments are repeatedly attached to and detached from the hook-shaped fastening elements. As a result, the peeling strength is lowered, and it is impossible to provide a sufficiently high fastening force.

When the mono-filament fineness is lowered to 3 denier, the compressive fatigue property, which is a substitute physical property of a permanent set in fatigue, is deteriorated, and the feeling of the hook-shaped fastening elements becomes rough and hard, and the feeling of the outer side material is affected by roughness and hardness of hook-shaped fastening elements.

On the other hand, when the mono-filament fineness exceeds 40 denier, that is, in the case of the fineness in a range of the substantial mono-filament yarn, the rigidity of the yarn is increased. Therefore, in the case of item (1), the pieces of pile do not rise perpendicularly, so that they can not be fastened to the hooks in a sufficient condition. In the case of the above items (2) and (3), they can not be blended by air jet in a good condition, and some portions can not be blended.

There are provided three methods of manufacturing the double knit goods of the present invention.

According to the first method, pile is formed in the process of knitting. In this method, using a knitting machine with equipment to open and close, a latch attached to a needle, knitting is conducted in accordance with the figured knitting lay-out shown in FIG. 4.

Figure 4:
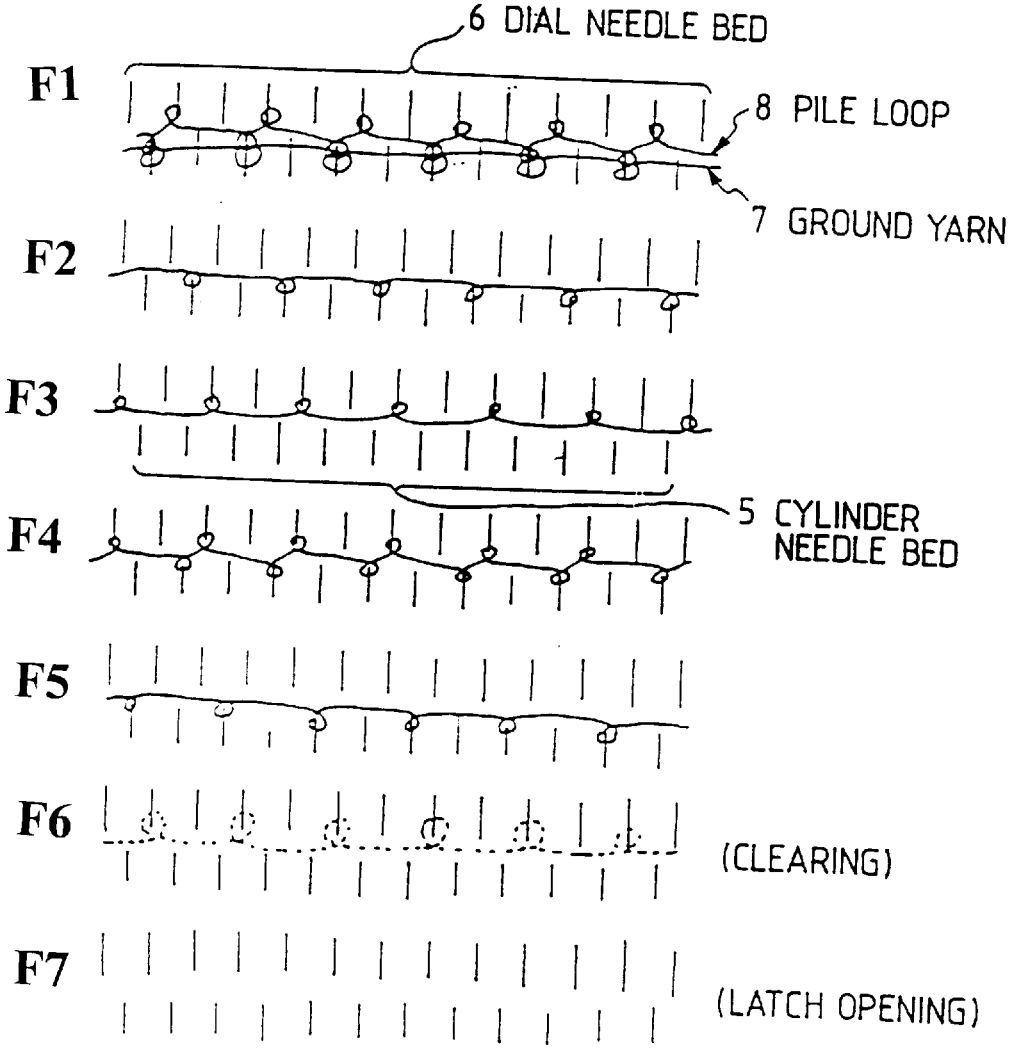
FIGS. 4 to 8 are knitting diagrams of the double knit goods for manufacturing the female member of the Hook-and-Loop fastener of the present invention.

In FIG. 4, reference numeral 5 is a cylinder needle bed, and reference numeral 6 is a dial needle bed. In this figured knitting lay-out, the ground stitches 7 are knitted on the cylinder needle bed, and the pile loops 8 are held by the needle bed and simultaneously held by the same needle as that holding the stitches 7 of the knit goods by the cylinder needle bed. This is necessary to prevent the pile loops 8 from coming off. In this connection, according to this organization, checkers are knitted on the cylinder side. In FIG. 4, numerals to which F is attached show an order of the knitting organization. The knitting organization indicated by F6 and F7 is a portion by which the method of forming the pile is characterized. While the yarn is not fed in step F6, the needles which are stayed yarn in the hooks of the dial needle bed instep F1 are raised to the stitch position by knitting cam, and the yarn is knocked over (clearing). In step F7, latches of the dial needles closed in step F6 are opened by the equipment to open latch (latch opening). In this way, the organization is circulated.

The second method is provided in such a manner that the obtained knit goods are subjected to after-treatment.

Specifically, this method is described as follows. Water-soluble fibers, for example, water-soluble vinylon is used structurally in the process of knitting as shown in FIG. 5, and the knit goods are dissolved at a predetermined dissolving temperature so as to obtain the pile.

Figure 5:
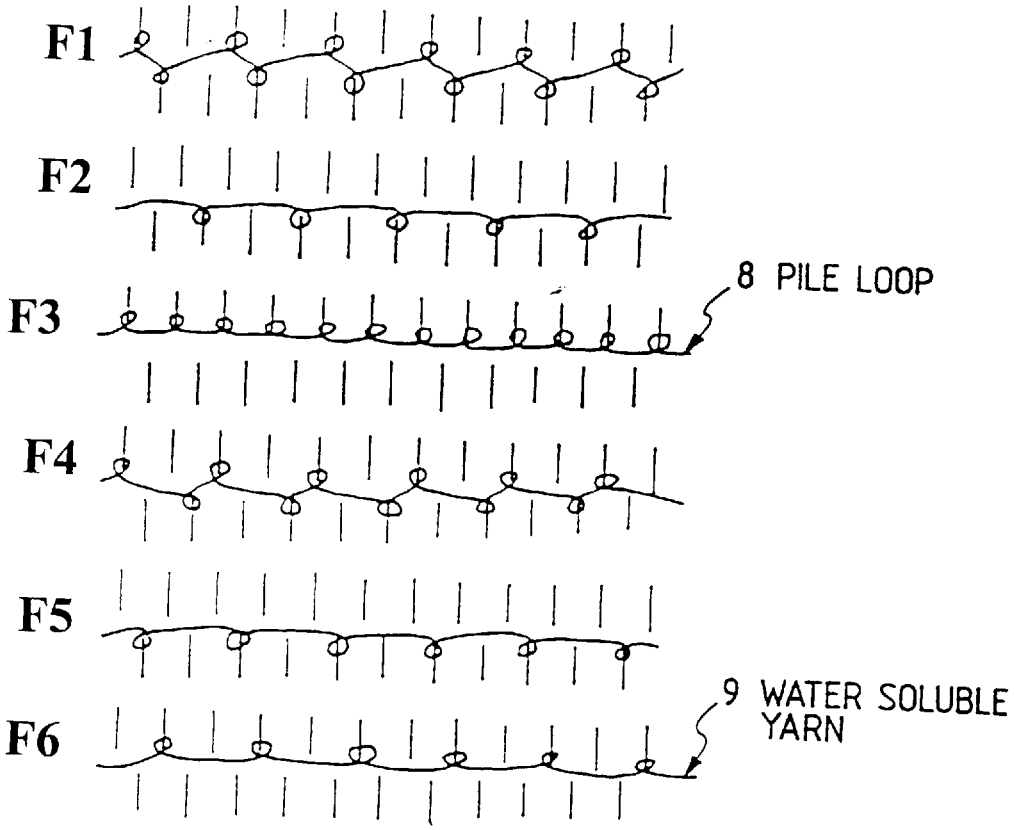

In FIG. 5, the yarn 9 to be formed into the pile loop is fed in step F3, and the water-soluble fibers 10, which is the characteristic of this method to form the pile, is fed in step F6.

The third method is different from the above two knitting methods. According to the third method, the pile loops are not structurally formed in the knit goods, but the yarn, on the surface of which ring-shaped loops are protruded, is knitted, so that a thin layer having the ring-shaped loops are formed on the surface of the knit goods. In this method, there are provided two cases. In one case, the thin layer of loops is knitted while the loops are formed, and in the other case, the loops are scraped out from the knit goods by means of napping.

Figure 6:
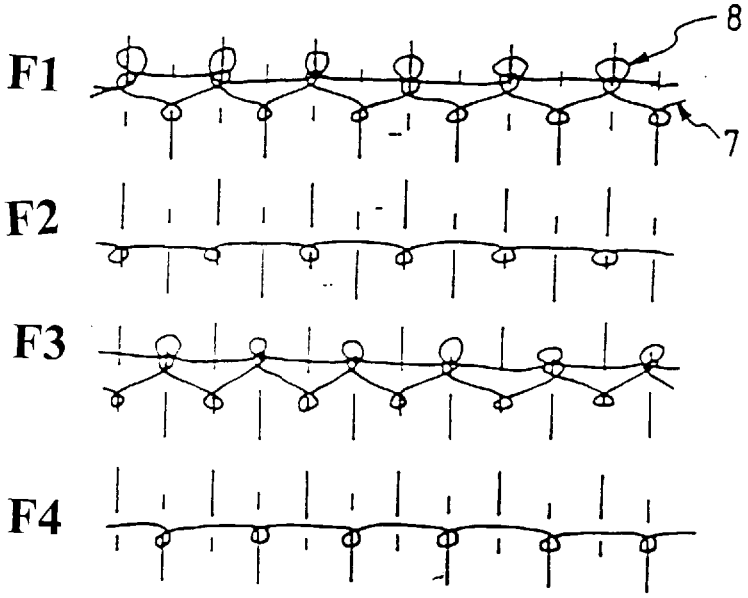

FIG. 6 is a view showing an organization which can be easily subjected to napping.

The above two knitting methods respectively have merits and demerits. The knitting efficiency of the first method is lower than that of second method, because the number of entrances to feed the yarn is increased according to the first method. Moreover, according to the first method, there is a tendency toward the inferior to open and close latch operating. Therefore, the first method is disadvantageous in that the quality of knit goods can not be stabilized.

In order to enhance the design of the knit goods, it can be considered to use a computer knitting machine so as to form a jacguard pattern. Since a jacguard pattern is formed on the cylinder needle bed side of the knitting machine, as shown in FIG. 4, a piece of yarn is knitted on the cylinder needle side, so that the pile loops can be fixed and the pile yarn can not come off. Consequently, since the pile yarn exists on the surface that must be designed appropriately, various forces are applied to the surface when the hook-shaped fastening elements are attached to and detached from the pieces of pile. Due to the foregoing, there is a possibility that the design of the surface is damaged.

The second method is disadvantageous in that the height of the pile loops is difficult to be adjusted and that the knit goods tends to elongate when the water-soluble fibers are dissolved and removed so as to form the pile. In order to solve the above problem in which the knit goods tends to elongate, the following measure may be taken. When FIG. 5 is taken for an example, the loop length of the 1×1 organization knitted on the cylinder needle bed side may be set to be shorter than the length of the dial all knit organization by 20 to 40%, or alternatively the yarn containing filaments, the shrinkage percentage of which is not less than 30%, may be used for the 1×1 organization knitted on the cylinder needle bed side.

Figure 7:
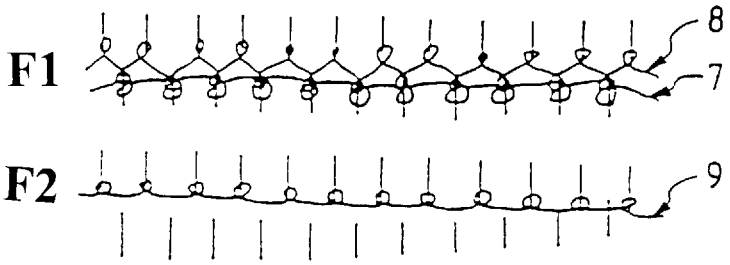

In this connection, in FIG. 7, it is possible to form an overall pile goods on one side with a double knitting machine. This corresponds to the sinker pile knit goods or the pole knit goods. However, as described before in the first method, the knit goods shown in FIG. 7 is knitted in such a manner that the yarn to fix the pile yarn is knitted on the cylinder needle bed side. Therefore, when the hook-shaped fastening elements are attached to and detached from the pile, the stitches on the cylinder surface are deformed.

The sinker pile knit goods is frequently used for a seat cloth for vehicle use while the pile side is set as the seat surface, under the condition that the pile loops are partially cut or the all-out pile loops are cutaway. In the same manner, the pole knit goods is used for a seat cloth while a pattern is printed on the surface, under the condition that the all-out pile loops are cut away. However, the sinker pile knit goods can not be used in the following manner. A pattern is printed on a surface opposite to the pile loop side of the sinker pile knit goods. After that, the pile loop surface is used as a fastening member to be fastened to the hook-shaped fastening elements, so that the knit goods is used for a seat cloth for vehicle use in which the fastening function and the cushion property are integrated.

The reason why the sinker knit goods can not be used in the above manner is described as follows. Since the pile loops exist as stitches on a surface opposite to the pile loop side, the quality of the design surface is deteriorated when the stitch loops are moved in the process of fastening.

On the other hand, since the pile knit goods is different from the sinker pile knit goods, even if the pole knit goods is used as a seat cloth for vehicle use, the quality of the design surface is seldom deteriorated. Therefore, from the viewpoint of performance of the pole knit goods, it can be used for a seat cloth. However, there are irregularities on a surface which is used as a print surface opposite to the pile loop surface. Due to the irregularities, this surface is not necessarily suitable for a print surface.

In order to use the knit goods as an outer side material of a seat invented by the present inventors, it is necessary that the hook-shaped fastening elements embedded in the base material of a seat are easily fastened to the pile loops of the knit goods in the seat assembling process, and further the design of the seat face must not be affected. For the above reasons, the aforementioned second method is preferably used as the knitting method to make the knit goods having pile loops.

The female member of a Hook-and-Loop fastener of the present invention manufactured in the above manner can be fastened to hook-shaped fastening elements of various shapes. For example, specific shapes of the fastening elements are an arrow shape, a two-step arrow shape, an arrow shape having ribs, a hook shape and a multi-step hook shape. In order to enhance the fastening property, it is preferable to use a fastening element formed into an arrow shape such as an arrow shape, a two-step arrow shape and an arrow shape having ribs. An example of the usable fastening element having such a shape is KM Fastener Rail which is a brand name manufactured by Kuraray Co., Ltd.

Concerning the size of the fastening element, it is preferable that the height is 1 to 3 mm, the maximum width of an arrow portion is 0.7 to 2 mm, and the element density is 40 to 300 pieces/$cm^2$.

When the female member of the Hook-and-Loop fastener of the present invention is fastened to a base member having fastening elements, the fastening strength is not less than 1.3 kg/cm$^2$ (shearing strength). Also, the fastening strength is not less than 500 g/cm (peeling strength). Since the female member of the Hook-and-Loop fastener of the present invention has such a high fastening property, the outer side material is not displaced even when various forces are applied to the outer side material after the female member has been fastened to the fastening elements. Moreover, even when the fastener is repeatedly detached, the outer side material is not affected.

[EMBODIMENT]

The present invention will be specifically explained referring to an embodiment. In this connection, the physical properties in the embodiment were found by the following methods.

(1) Percentage crimp

After the yarn has been wound by a yarn reeler so that a hank of 5000 denier can be obtained, a load of 10 g is hung at the center of the lower end of the hank. A center of the upper portion of this hank is fixed. Under the condition that a load of 0.01 g/d is given, the yarn is subjected to hot water treatment at 90° C. for 30 minutes. While no load is given, the yarn is left at the room temperature and dried. After that, a load of 10 g is given again, and the yarn is left in the above condition for 5 minutes. Then the yarn length is measured. Thus measured length is $L_1$ (mm). Next, a load of 1 Kg is given, and the yarn is left in the above condition for 30 seconds. Then the yarn length is measured. The thus measured length is $L_2$ (mm). The percentage crimp $K_1$ is found by the following expression.

$$K_1\ (\%)=\{(L_2-L_1)/L_2\}\times 100$$

(2) Fastening strength

JIS L-3416

Concerning the hook surface of the Hook-and-Loop fastener, KM Fastener Rail X6320-3 (manufactured by Kuraray Co., Ltd.) was used. The specification of KM Fastener Rail X6320-3 is described as follows. The shape of the fastening element is a two step arrow shape. The fastening element density is 44 pieces/cm2. The height of the fastening element is approximately 1.5 mm. The thickness of the fastening element is approximately 0.6 mm. The maximum width of the arrow is 1 mm.

(3) Number of the ring-shaped loops

By using a hairiness counter produced DT-201 by TORE Engineering Co., Ltd., the number of fibers exceeding a predetermined distance from the center of yarn so as to calculates the number of ring-shaped loops. It is assumed that the number of fibers exceeding more than 1 mm from the center of yarn is H0, and as similar, more than 3 mm is H1. Then, the number of ring-shaped loops having the height of 1 to 3 mm.

$$H=(H0-H1)/2$$

(4) Compression fatigue property

JIS L-1021

The knitting condition was determined as follows in the embodiment and the comparative example.

Knitting Condition

Figure 8:
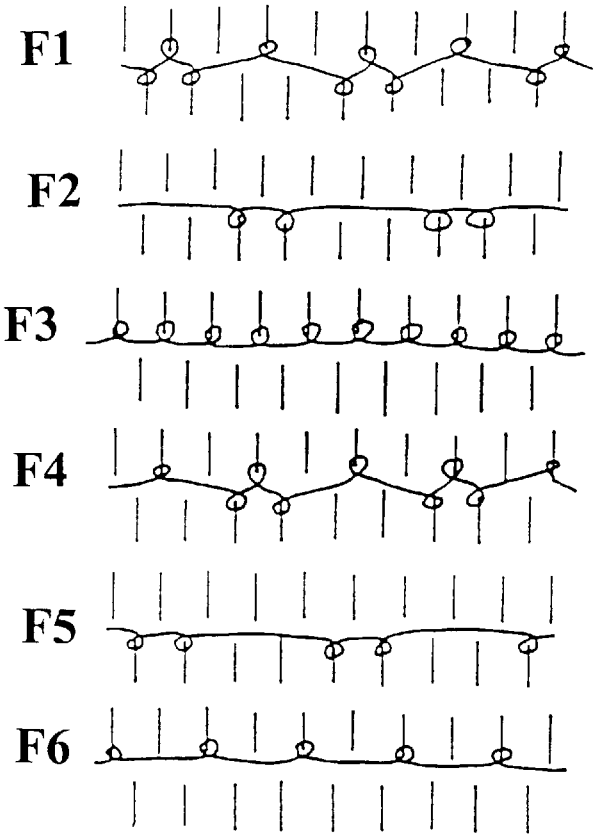

A circular double knitting machine of 30 inch and 14 gauge is used, and the cams are incorporated so that the figured knitting lay-out shown in FIG. 8 can be obtained.

In each embodiment and comparative example, two different types of knit goods were manufactured from the same organization and evaluated. That is, evaluation was conducted on the knit goods in which the pieces of yarn having the fastening function risen as the pile on one side of the knit goods. Also, evaluation was conducted on the knit goods in which the pieces of yarn having the fastening property were arranged on the same surface as that of the kit goods without rising.

An organization in which the pieces of yarn having the fastening function risen as the pile on one side of the knit goods is referred to as a pile organization. In order to make the double knit goods of this organization, water soluble vinylon yarn of 28 denier was used for the yarn feed entrance No. 6. After knitting, the knit goods was treated in warm water of 70° C. so that the water soluble vinylon yarn was dissolved and removed. In this way, the pile was raised. This procedure was common among the embodiments and the comparative example.

An organization in which the pieces of yarn having the fastening function are arranged on the same surface as that of the knit goods is referred to as a non-pile organization. In this case, polyester filaments 50/36 were used for the yarn feed entrance No. 6. This procedure was common among the embodiments and the comparative example.

The yarn used for the yarn feed entrances No. 1, 2, 4 and 5 was provided as follows. Two pieces of false twist yarn SD 150/48 composed of polyester filaments, and polyester filaments SD 100/36, the boiling shrinkage percentage of which was 40%, were arranged and fed into the interlacer. They were subjected to interlacement under the condition that the over feed ratio was 3% and the air pressure was 1.5 kg/cm$^2$. The finished yarn of 400 denier obtained in the above manner was used. This procedure was common among the embodiments and the comparative example.

The yarn used for the yarn feed entrance No. 3 becomes the rising yarn in the double knit goods or becomes the non-pile organization, so that it exhibits the fastening function. The detail of the yarn used for the yarn feed entrance is described below.

Embodiment 1 (Yarn used for the yarn feed entrance No. 3)

The drawn yarn 350/48 of polyester filaments was subjected to the false twisting treatment under the condition shown on the following table 1, and the finished yarn, the value $K_1$ of which was 25%, was obtained. Further, the finished yarn was processed by a vacuum setting machine under the condition of 130° C.×10 min. In this way, the finished yarn, the value $K_1$ of which was 4%, was obtained.

TABLE 1

| NUMBER OF FALSE TWISTING | FIRST HEATER TEMPERATURE | SECOND HEATER TEMPERATURE |
|---|---|---|
| Z1600T/W | 200° C. | 180° C. |

Embodiment 2 (Yarn used for the yarn feed entrance No. 3)

The drawn yarn 200/48 of polyester filaments, and the two step heater false twist yarn composed of 150/32 polyester filaments, the value $K_1$ of which was 25%, were subjected to interlacing treatment at the air pressure of 3.0 kg/cm$^2$. In this way, the air blended yarn, the number of tangling parts of which was 112 pieces/m, was obtained.

Embodiment 3 (Yarn used for the yarn feed entrance No. 3)

The drawn yarn 100/20 of polyester filaments was used as the sheath yarn and fed into the air jet nozzle under the condition that the over feed ratio was 70%, and the drawn yarn 150/72 of polyester filaments was used as the cores and fed into the air jet nozzle under the condition that the over feed ratio was 10%, and they were processed at the air pressure of 4.5 kg/cm$^2$. On the surface of the thus obtained Taslan yarn, there were provided ring-shaped loops, the size of which was 1 to 3 mm, and the number of which was 70 pieces/10 cm.

Embodiment 4 (Yarn used for the yarn feed entrance No. 3)

The drawn yarn 100/36 of polyester filaments, the boiling shrinkage ratio of which was 35%, and the low crimped false twist yarn 150/32 ($K_1$ was 15%) of polyester filaments, the boiling shrinkage ratio of which was 6%, were subjected to air combination at the air pressure of 3.0 kg/cm$^2$. In this way, the air blended yarn, the number of tangling parts of which was 120 pieces/m, was obtained. The thus obtained yarn was knitted to be tube with a circular knitting machine of 12 gauge, and processed under the condition of 130° C.×10 min. These pieces of yarn were arranged and twisted with Z 50T/M.

Comparative Example 1 (Yarn used for the yarn feed entrance No. 3)

The drawn yarn 350/48 of polyester filaments used in Embodiment 1 was used as it was.

Comparative Example 2 (Yarn used for the yarn feed entrance No. 3)

The temporarily twisted yarn ($K_1$ was 25%) obtained when the drawn yarn 350/48 of polyester filaments used in Embodiment 1 was used.

Table 2 shows the fastening strength and the compression fatigue property of the embodiments of the present invention and the comparative examples. As can be seen on Table 2, it is possible to provide a sufficiently high fastening force by the pile organization and the non-pile organization of the present invention. Concerning the peeling strength which is important to fix the outer side material, it is impossible to obtain a sufficiently high peeling strength by the multi-filaments used in the comparative examples. The comparative examples 2 and 3 are characterized in that the fastening strength was increased, although the increment was small, when the frequency of the repetition was increased. However, a quantity of pile was increased, and the filaments were cut away.

Accordingly, the double knit goods of the present invention in which the fastening function is integrated is excellent in the initial fastening strength, and even after the Hook-and-Loop fastener has been repeatedly detached several times, the fastening property can be maintained high. That is, the double knit goods of the present invention is an excellent female member of a Hook-and-Loop fastener.

TABLE 2

| EVALUATED | | SHEARING STRENGTH (Kg/cm$^2$) | | PEELING STRENGTH (g/10 mm) | | COMPRESSION FATIGUE PROPERTY |
|---|---|---|---|---|---|---|
| EXAMPLE | ORGANIZATION | 1ST TIME | 5TH TIME | 1ST TIME | 5TH TIME | (%) |
| EMBODIMENT 1 | PILE | 1.88 | 1.84 | 924 | 873 | 17.4 |
| | NON-PILE | 0 | 0 | 0 | 0 | — |
| EMBODIMENT 2 | PILE | 1.74 | 1.66 | 639 | 571 | 23.5 |
| | NON-PILE | 0 | 0 | 0 | 0 | — |
| EMBODIMENT 3 | PILE | 1.81 | 1.80 | 822 | 805 | 19.6 |
| | NON-PILE | 1.33 | 1.65 | 431 | 472 | 24.1 |
| EMBODIMENT 4 | PILE | 2.10 | 1.96 | 951 | 897 | 29.4 |
| | NON-PILE | 1.68 | 1.54 | 710 | 670 | 26.1 |
| COMPARATIVE | PILE | 0.78 | 0.99 | 96 | 88 | 42.0 |
| EXAMPLE 1 | NON-PILE | 0 | 0 | 0 | 0 | — |
| COMPARATIVE | PILE | 0.62 | 1.40 | 70 | 84 | 22.8 |
| EXAMPLE 2 | NON-PILE | 0 | 0 | 0 | 0 | — |
| COMPARATIVE | PILE | 0.33 | 0.47 | 64 | 71 | 19.5 |
| EXAMPLE 3 | NON-PILE | 0 | 0 | 0 | 0 | — |
| COMPARATIVE | PILE | 1.16 | 1.12 | 404 | 352 | 37.5 |
| EXAMPLE 4 | NON-PILE | 0.19 | 0.76 | 88 | 206 | 44.9 |

Comparative Example 3 (Yarn used for the yarn feed entrance No. 3)

The two step heater false twist yarn 150/32 of polyester filaments was subjected to interlacing treatment at the air pressure of 1.5 kg/cm$^2$, and the air blended yarn, the number of tangling parts of which was 112 pieces/m, was obtained.

Comparative Example 4 (Yarn used for the yarn feed entrance No. 3)

The drawn yarn 100/20 of polyester filaments was used as the sheath yarn and fed into the air jet nozzle under the condition that the over feed ratio was 20%, and the drawn yarn 150/72 of polyester filaments was used as the cores and fed into the air jet nozzle under the condition that the over feed ratio was 7%, and they were processed at the air pressure of 4.5 kg/cm$^2$. On the surface of the thus obtained Taslan yarn, there were provided ring-shaped loops, the size of which was 1 to 3 mm, and the number of which was 20 pieces/10 cm.

The female member of a Hook-and-Loop fastener made of double knit goods according to the present invention has an interior decoration of the cloth for a seat in which fastening and cushion functions are integrated. It is easy and simple to be fixed to a seat used for a vehicle or an aircraft, a cloth to cover a chair used in an office, and has a good ability for fitting a seat having a curved surface. Accordingly, the female member of a Hook-and-Loop fastener is extremely useful as the outer side material of these seats.

It is claimed:

1. A female member of a hook-and-loop fastener made of double knit goods, comprising a pile provided at least in a portion on one side of the double knit goods; the pile comprising one of crimped yarn, the percentage crimp of which is not more than 15%, and blended yarn composed of crimped filaments and uncrimped filaments; wherein the single fiber fineness of filaments composing the yarn is not less than 3 denier; and the yarn is knitted together with the yarn composing the other side of the double knit goods only on the one side.

2. A female member of a hook-and-loop fastener made of double knit goods, wherein a yarn having ring-shaped loops, the height of which is 1 mm to 3 mm is provided on one side of the double knit goods; the single fiber fineness of filaments composing the yarn is not less than 3 denier; and the yarn is knitted together with the yarn composing the other side of the double knit goods only on the one side.

3. A female member of a hook-and-loop fastener according to claim 2, wherein the yarn rises on the one side of the double knit goods in the form of pile.

* * * * *